US009581344B2

(12) United States Patent
Cho et al.

(10) Patent No.: US 9,581,344 B2
(45) Date of Patent: Feb. 28, 2017

(54) DEHUMIDIFIER

(71) Applicant: SAMSUNG ELECTRONICS CO., LTD., Suwon-si (KR)

(72) Inventors: Chang Hwan Cho, Suwon-si (KR); In Chul Yun, Yongin-si (KR); Ki Sup Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 213 days.

(21) Appl. No.: 14/323,174

(22) Filed: Jul. 3, 2014

(65) Prior Publication Data

US 2015/0013371 A1 Jan. 15, 2015

(30) Foreign Application Priority Data

Jul. 4, 2013 (KR) ..... 10-2013-0078569

(51) Int. Cl.

| | |
|---|---|
| ***F25D 17/06*** | (2006.01) |
| ***F25D 21/00*** | (2006.01) |
| ***F25D 17/04*** | (2006.01) |
| ***F24F 3/14*** | (2006.01) |
| *F24F 1/02* | (2011.01) |
| *F24F 11/02* | (2006.01) |
| *F24F 13/10* | (2006.01) |

(52) U.S. Cl.

CPC ..... *F24F 3/1405* (2013.01); *F24F 1/022* (2013.01); *F24F 11/027* (2013.01); *F24F 13/10* (2013.01); *F24F 2003/1446* (2013.01); *F24F 2003/1452* (2013.01); *F24F 2221/56* (2013.01)

(58) Field of Classification Search

CPC ..... F24F 3/1405; F24F 1/022; F24F 11/027; F24F 2221/56; F24F 2003/1446; F24F 2003/1452; F24F 13/10

USPC ..... 62/272, 93, 90, 408–412, 419, 426–429, 62/498, 506, 507

See application file for complete search history.

(56) References Cited

U.S. PATENT DOCUMENTS

| | | | | |
|---|---|---|---|---|
| 2,984,089 | A * | 5/1961 | Whitesel | 62/429 |
| 4,748,829 | A * | 6/1988 | Whiteman | F24F 1/022 137/597 |
| 5,782,102 | A * | 7/1998 | Iritani et al. | 62/197 |
| 2008/0229776 | A1 * | 9/2008 | Kim et al. | 62/411 |

(Continued)

FOREIGN PATENT DOCUMENTS

| | | |
|---|---|---|
| JP | 9-89297 | 4/1997 |
| JP | 10-203148 | 8/1998 |

(Continued)

OTHER PUBLICATIONS

Machine Translation of JP2004-028382.*

(Continued)

*Primary Examiner* — Ryan J Walters
*Assistant Examiner* — Joseph Trpisovsky
(74) *Attorney, Agent, or Firm* — Staas & Halsey LLP

(57) ABSTRACT

A dehumidifier including an evaporator, a condenser, and a fan arranged in a main body. The fan includes a first blowing part to blow air having passed through both the evaporator and the condenser, and a second blowing part to selectively blow any one of air having passed through both the condenser and the evaporator and air having passed through only the evaporator. The dehumidifier may additionally function to supply cold air.

20 Claims, 8 Drawing Sheets

(56) References Cited

U.S. PATENT DOCUMENTS

2010/0089090 A1 4/2010 Kim et al.

FOREIGN PATENT DOCUMENTS

| | | |
|---|---|---|
| JP | 2001-99443 | 4/2001 |
| JP | 2001-221496 | 8/2001 |
| JP | 2004-28382 | 1/2004 |

OTHER PUBLICATIONS

European Decision on Grant dated Dec. 16, 2015 in corresponding European Patent Application No. 14175722.9.
Espacenet Abstract, Publication No. JPH0989297, Published Apr. 4, 1997.
Espacenet Abstract, Publication No. JPH10203148, Published Aug. 4, 1998.
Patent Abstracts of Japan, Publication No. 2001099443, Published Apr. 13, 2001.
Espacenet Abstract, Publication No. JP2001221496, Published Aug. 17, 2001.
Espacenet Abstract, Publication No. JP2004028382, Published Jan. 29, 2004.
International Search Report of International Application No. PCT/KR2014/006002 mailed Oct. 27, 2014.
European Search Report of European Application No. 14175722.9 mailed Dec. 5, 2014.

* cited by examiner

DEHUMIDIFIER

CROSS-REFERENCE TO RELATED APPLICATIONS

This application claims the benefit of Korean Patent Application No. 10-2013-0078569, filed on Jul. 4, 2013, in the Korean Intellectual Property Office, the disclosure of which is incorporated herein by reference.

BACKGROUND

1. Field

Embodiments of the present invention relate to a dehumidifier used to reduce the humidity of an indoor space.

2. Description of the Related Art

Generally, a dehumidifier is an apparatus used to reduce the humidity of an indoor space. The dehumidifier includes components of a refrigeration cycle, such as a compressor, a condenser, an expansion valve, and an evaporator, as well as a fan to move air of an indoor space through a main body defining an external appearance of the dehumidifier, all of which are accommodated within the main body.

Accordingly, when the air of the indoor space passes through the evaporator within the main body, moisture contained in the air is condensed on a surface of the evaporator, causing dehumidification of the air. Then, the dehumidified air passes through the condenser to condense refrigerant passing through the condenser. While passing through the condenser, the air is heated by absorbing heat from the refrigerant inside the condenser. In this way, the air of the indoor air attains reduced humidity and increased temperature while passing through the main body of the dehumidifier.

SUMMARY

It is an aspect of the present invention to provide a dehumidifier which may provide cold air as well as dehumidification.

Additional aspects of the invention will be set forth in part in the description which follows and, in part, will be obvious from the description, or may be learned by practice of the invention.

In accordance with one aspect of the invention, a dehumidifier includes a main body, an evaporator and a condenser arranged within the main body, and a fan to suction air into the main body and then discharge the air from the main body, wherein the fan includes a first blowing part to blow air having passed through both the evaporator and the condenser, and a second blowing part to selectively blow any one of air having passed through both the condenser and the evaporator and air having passed through only the evaporator.

The fan may be a bidirectional suction fan to suction air in opposite axial directions and to discharge the air in an outward radial direction, the first blowing part may suction air in one axial direction and discharge the air in an outward radial direction, and the second blowing part may suction air in an opposite axial direction and discharge the air in an outward radial direction.

The main body may include a suction aperture through which air is suctioned, a first discharge aperture through which air discharged from the first blowing part is discharged outward, and a second discharge aperture through which air discharged from at least the second blowing part among the first blowing part and the second blowing part is discharged outward.

The dehumidifier may further include a first damper to guide any one of air having passed through both the evaporator and the condenser and air having passed through only the evaporator so as to be selectively suctioned into the second blowing part.

The main body may include a first suction path to guide air having passed through the evaporator to the condenser, a second suction path to guide air having passed through the condenser to the first blowing part, a third suction path branched from the first suction path to allow some of the air having passed through the evaporator to bypass the condenser, and a fourth suction path to guide air to be suctioned into the second blowing part, and the first damper may selectively connect any one of the second suction path and the third suction path to the fourth suction path.

The first damper may be rotatably installed at a point where the second suction path, the third suction path and the fourth suction path meet one another, and may close any one of the second suction path and the third suction path via rotation thereof.

The dehumidifier may further include a second damper to guide air blown by the first blowing part so as to be selectively discharged through any one of the first discharge aperture and the second discharge aperture.

The main body may include a first discharge path to guide air to the first discharge aperture and a second discharge path to guide air to the second discharge aperture, and the second damper may allow air discharged from the first blowing part to be delivered to any one of the first discharge path and the second discharge path.

The second damper may be rotatably installed at a boundary of the first discharge path and the second discharge path.

The dehumidifier may further include a drive motor to generate torque so as to rotate the blowing fan, and a guide duct configured to receive the blowing fan, the guide duct guiding air discharged from the blowing fan, and the guide duct may include a first duct in which the first blowing part is received, the first duct guiding air discharged from the first blowing part, and a second duct in which the second blowing part is received, the second duct guiding air discharged from the second blowing part.

The main body may accommodate a drain pan located below the evaporator, and a condensed water storage container in which condensed water delivered from the drain pan is stored.

In accordance with another aspect of the present invention, a dehumidifier includes a main body, an evaporator and a condenser arranged within the main body, and a fan to allow air to be suctioned into the main body and then discharged from the main body, wherein the fan includes a first blowing part to suction air in one axial direction and discharge the air in an outward radial direction, and a second blowing part to suction air in an opposite axial direction and discharge the air in an outward radial direction, and wherein the main body includes a suction aperture through which air is suctioned, a first suction path to guide air, having suctioned through the suction aperture and passed through the evaporator, to the condenser, a second suction path to guide air having passed through the condenser to the first blowing part, a third suction path branched from the first suction path to allow some of the air having passed through the evaporator to bypass the condenser, a fourth suction path to guide air to be suctioned into the second blowing part, and a first damper to connect any one of the second suction path and the third suction path to the fourth suction path.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
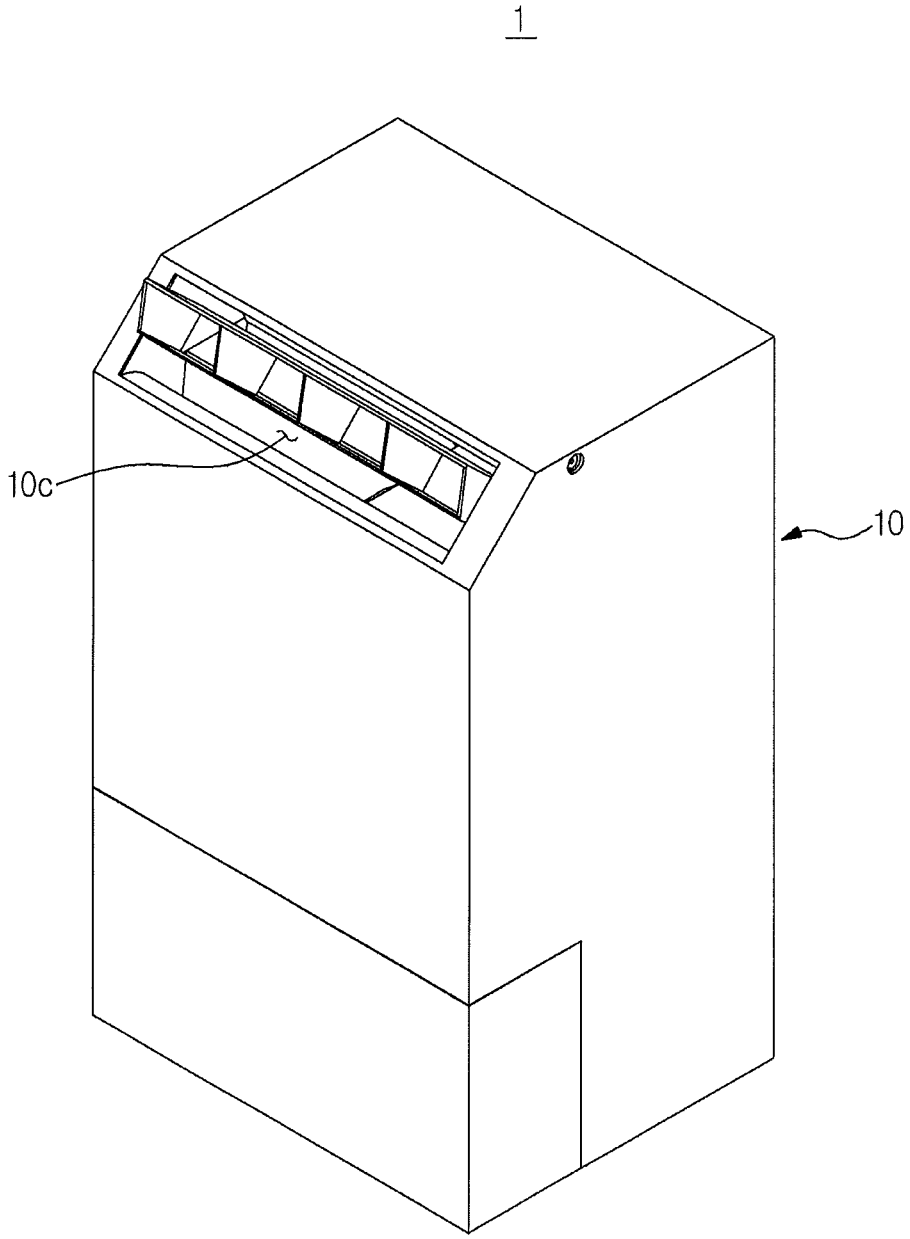
FIG. 1 is a front perspective view of a dehumidifier according to one embodiment of the present invention.

Reference will now be made in detail to a dehumidifier according to embodiments of the present invention, examples of which are illustrated in the accompanying drawings, wherein like reference numerals refer to like elements throughout.

Figure 2:
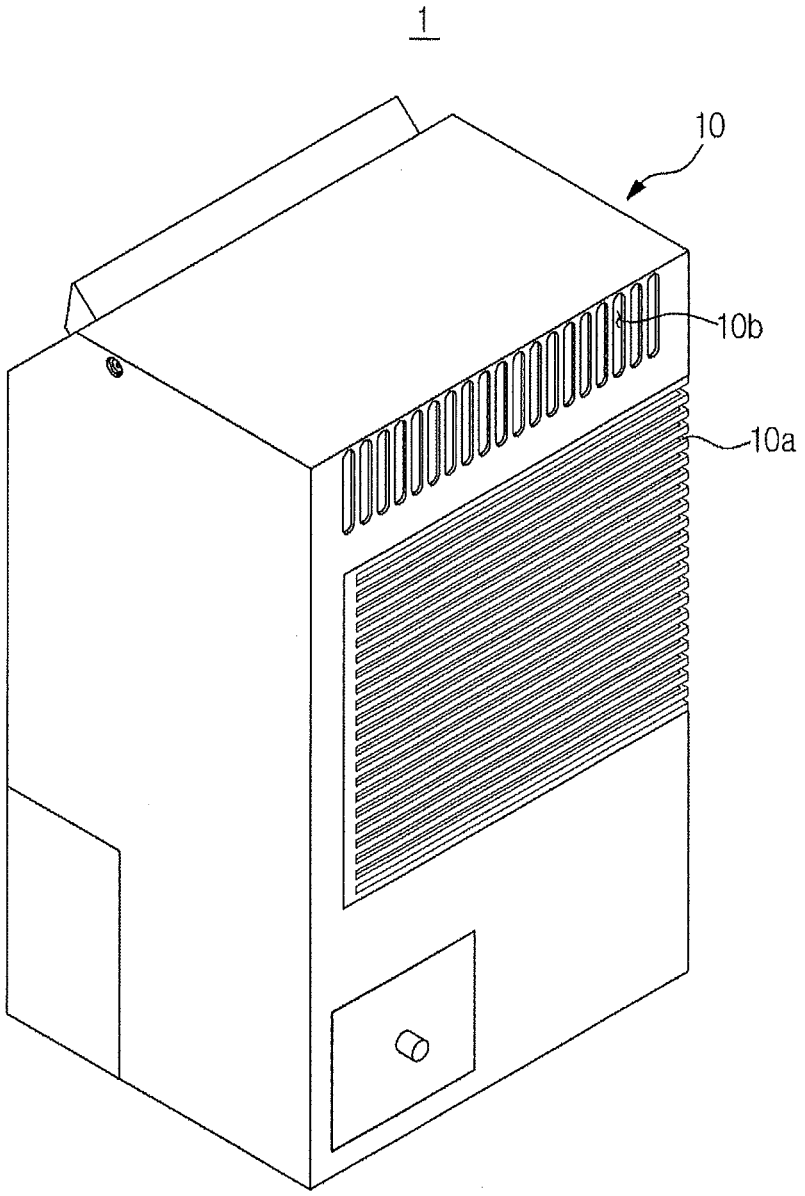
FIG. 2 is a rear perspective view of the dehumidifier according to the embodiment of the present invention.
Figure 3:
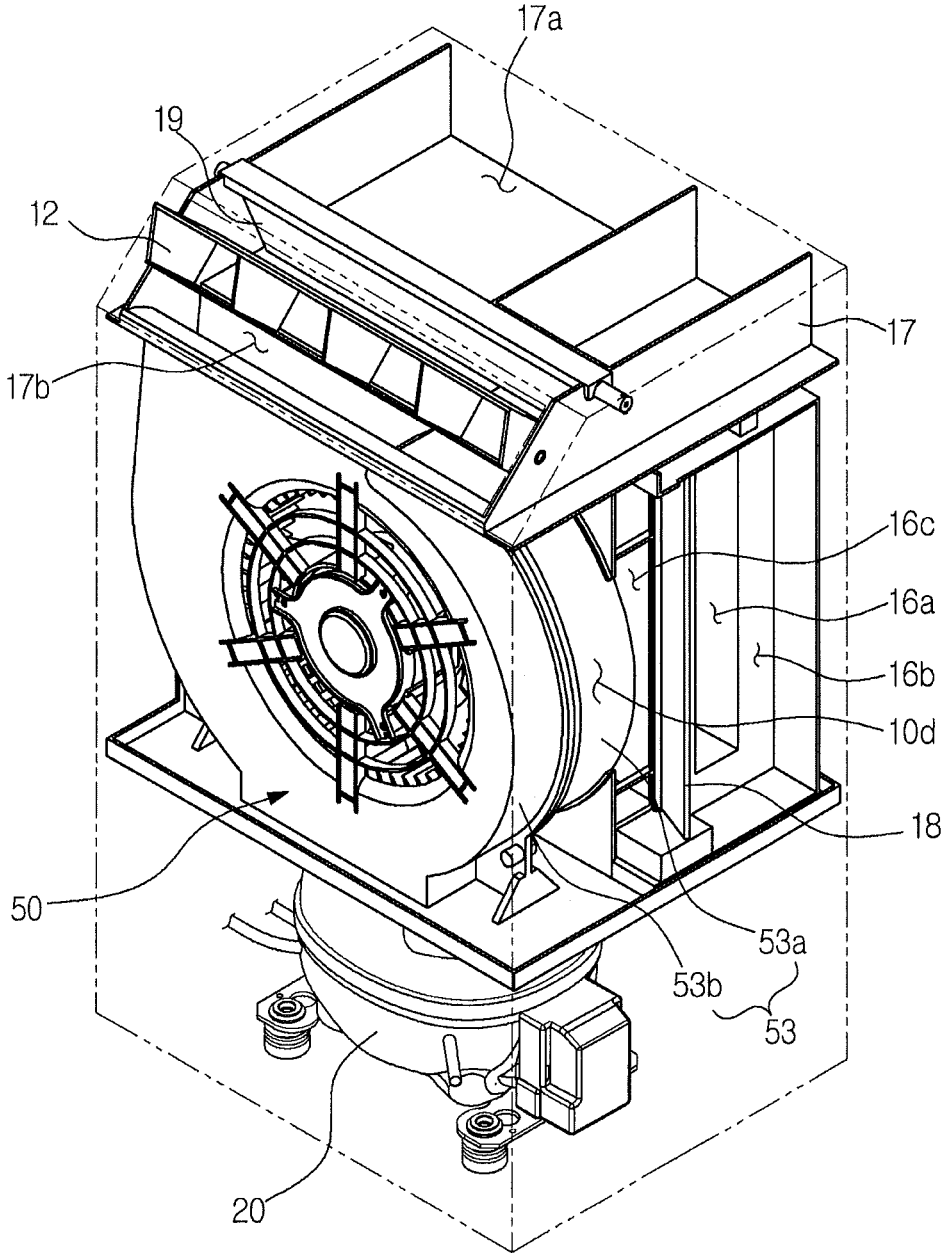
FIG. 3 is a perspective view showing an inner configuration of the dehumidifier according to the embodiment of the present invention.
Figure 4:
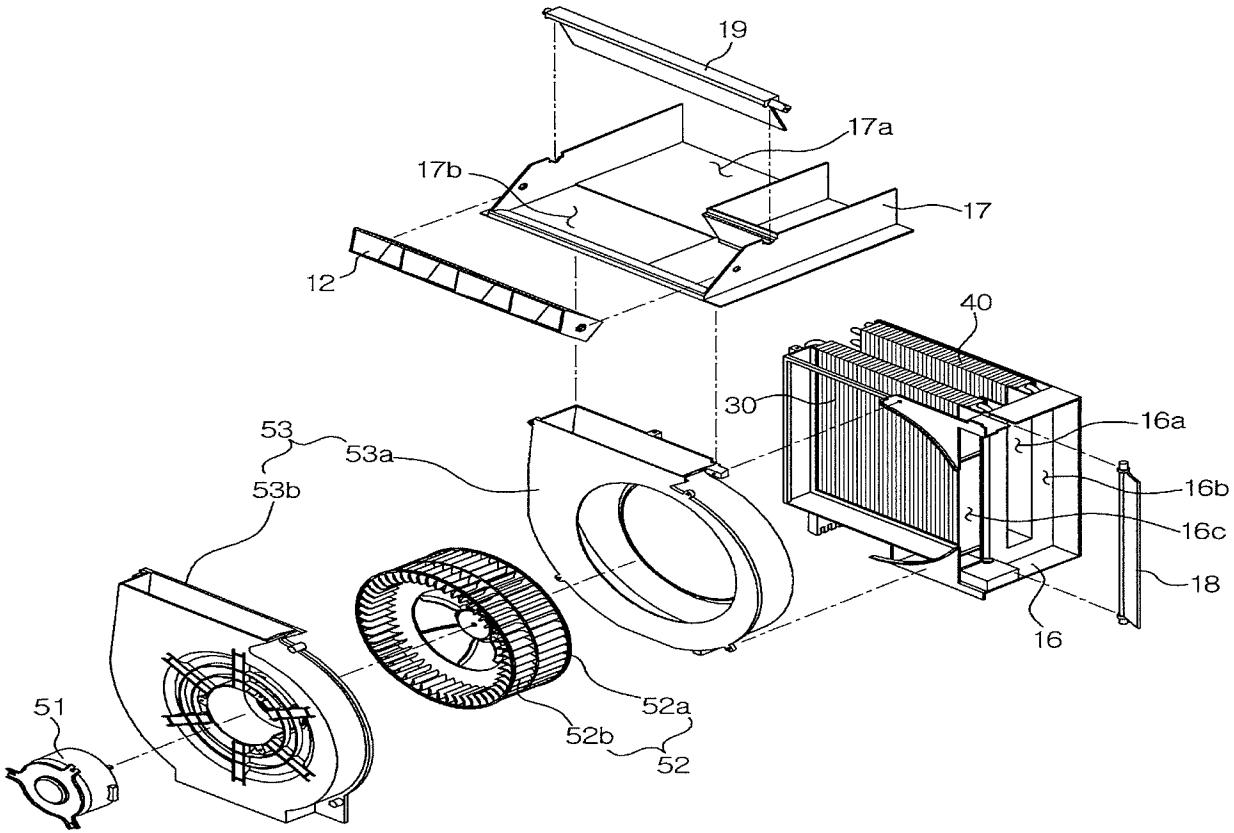
FIG. 4 is an exploded perspective view showing the inner configuration of the dehumidifier according to the embodiment of the present invention.

As exemplarily shown in FIGS. 1 and 2, the dehumidifier 1 according to one embodiment of the present invention includes a main body 10 defining an external appearance of the dehumidifier 1. As exemplarily shown in FIGS. 3 to 5, the main body 10 accommodates a compressor 20 to compress refrigerant, a condenser 30 in which the refrigerant is cooled and condensed by air passing through the main body 10, an expansion valve (not shown) to depressurize and expand the refrigerant, an evaporator 40 in which the depressurized and expanded refrigerant evaporates by absorbing heat from the air introduced into the main body 10, and a blowing unit 50 to pass the air through the main body 10.

The main body 10 has a suction aperture 10*a* through which air of an indoor space is suctioned into the main body 10, a first discharge aperture 10*b* through which air having passed through both the evaporator 40 and the condenser 30 is discharged outward from the main body 10, and a second discharge aperture 10*c* through which any one of air having passed through only the evaporator 40 and air having passed through both the condenser 30 and the evaporator 40 is selectively discharged outward from the main body 10. In the present embodiment, the second discharge aperture 10*c* is formed in a front surface of the main body 10, and the suction aperture 10*a* and the first discharge aperture 10*b* are formed in a rear surface of the main body 10.

The main body 10 includes a grill member 11 installed at the suction aperture 10*a* and a discharge guide 12 installed at the second discharge aperture 10*c*. The grill member 11 has a lattice shape, and functions to cover the suction aperture 10*a* and to allow air to be suctioned through the suction aperture 10*a* through the grill member 11. The discharge guide 12 is rotatably installed at the second discharge aperture 10*c*, and functions to adjust the direction of air discharged through the second discharge aperture 10*c* via rotation thereof and to close the second discharge aperture 10*c*.

In addition, the main body 10 accommodates a drain pan 13 located below the evaporator 40 such that condensed water generated in the evaporator 40 is collected, and a condensed water storage container 14 removably mounted in the main body 10 such that condensed water delivered from the drain pan 13 is stored therein.

The evaporator 40 is placed inside the suction aperture 10*a* to face the suction aperture 10*a*. In the present embodiment, the suction aperture 10*a* has a slightly greater size than a size of the evaporator 40, such that a major part of air suctioned through the suction aperture 10*a* passes through the evaporator 40 and the other minor part of air bypasses the evaporator 40. This serves to ensure blowing of a sufficient amount of air.

The blowing unit 50 includes a drive motor 51 to generate torque, a fan 52 to generate suction and blowing force while being rotated by the drive motor 51, and a guide duct 53 to guide air discharged from the fan 52 received therein.

The fan 52 takes the form of a bidirectional suction fan that suctions air in opposite axial directions and discharges the air in an outward radial direction. To this end, the fan 52 includes a first blowing part 52*a* to suction air in one axial direction and discharge the air in an outward radial direction, and a second blowing part 52*b* to suction air in an opposite axial direction and discharge the air in an outward radial direction. The first blowing part 52*a* functions to blow air having passed through both the condenser 30 and the evaporator 40, whereas the second blowing part 52*b* functions to selectively blow any one of air having passed through both the condenser 30 and the evaporator 40 and air having passed through only the evaporator 40.

The guide duct 53 is divided into a first duct 53*a* in which the first blowing part 52*a* is received and a second duct 53*b* in which the second blowing part 52*b* is received. The first duct 53*a* guides air discharged from the first blowing part 52*a*, and the second duct 53*b* guides air discharged from the second blowing part 52*b*.

The main body 10 further accommodates a plurality of suction paths 16*a*, 16*b*, 16*c*, 10*d* to guide air, suctioned into the main body 10 through the suction aperture 10*a*, to the fan 52, and a plurality of discharge paths 17*a*, 17*b* to guide air, discharged from the fan 52, to the first discharge aperture 10*b* or the second discharge aperture 10*c*.

The first suction path 16*a* guides air having passed through the evaporator 40 to the condenser 30, the second suction path 16*b* guides air having passed through the condenser 30 to the first blowing part 52*a*, the third suction path 16*c* branched from the first suction path 16*a* allows some of the air having passed through the evaporator 40 to bypass the condenser 30, and the fourth suction path 10*d* selectively connects to any one of the second suction path 16*b* and the third suction path 16*c* to guide air such that any one of air having passed through both the evaporator 40 and the condenser 30 and air having passed through only the evaporator 40 is selectively suctioned into the second blowing part 52*b*. In the present embodiment, the first suction path 16*a*, the second suction path 16*b*, and the third suction path 16*c* are defined by a first path defining member 16, which is placed in the main body 10 to support the evaporator 40 and the condenser 30. The fourth suction path 10*d* is defined by a space between the main body 10 and the guide duct 53.

A first damper 18 is rotatably installed at a boundary of the second suction path 16*b*, the third suction path 16*c*, and the fourth suction path 10*d*. The first damper 18 functions to close any one of the second suction path 16*b* and the third suction path 16*c* and simultaneously connect the other one to the fourth suction path 10*d* while being rotated, thereby allowing air to move from any one of the second suction path 16*b* and the third suction path 16*c* to the fourth suction path 10*d*.

When the dehumidifier 1 is operated in a dehumidification mode, the first damper 18 closes the third suction path 16*c* and connects the second suction path 16*b* and the fourth suction path 10*d* to each other. When the dehumidifier 1 is operated in a cold air supply mode, the first damper 18 closes the second suction path 16*b* and connects the third suction path 16*c* and the fourth function path 10*d* to each other.

The first discharge path 17*a* guides air to the first discharge aperture 10*b* and the second discharge path 17*b* guides air to the second discharge aperture 10*c*. The first discharge path 17*a* selectively guides air discharged from the first blowing part 52*a* to the first discharge aperture 10*b*. The second discharge path 17*b* guides air discharged from the second blowing part 52*b* among the first blowing part 52*a* and the second blowing part 52*b* to the second discharge aperture 10*c*. In the present embodiment, the discharge paths 17*a*, 17*b* are defined by a second path defining member 17 located above the evaporator 40 and the condenser 30.

A second damper 19 is located at a boundary of the first discharge path 17*a* and the second discharge path 17*b* to allow air discharged from the first blowing part 52*a* to be delivered to any one of the first discharge path 17*a* and the second discharge path 17*b*.

When the dehumidifier 1 is operated in a dehumidification mode, the second damper 19 connects the second duct 53*b* and the second discharge path 17*b* to each other to allow air discharged from the second blowing part 52*b* to be delivered to the second discharge path 17*b*. When the dehumidifier 1 is operated in a cold air supply mode, the second damper 19 connects the second duct 53*b* and the first discharge path 17*a* to each other to allow air discharged from the second blowing part 52*b* to be delivered to the first discharge path 17*a*.

Next, operation of the dehumidifier 1 having the above described configuration according to the embodiment of the present invention will be described in detail with reference to the drawings.

Figure 5:
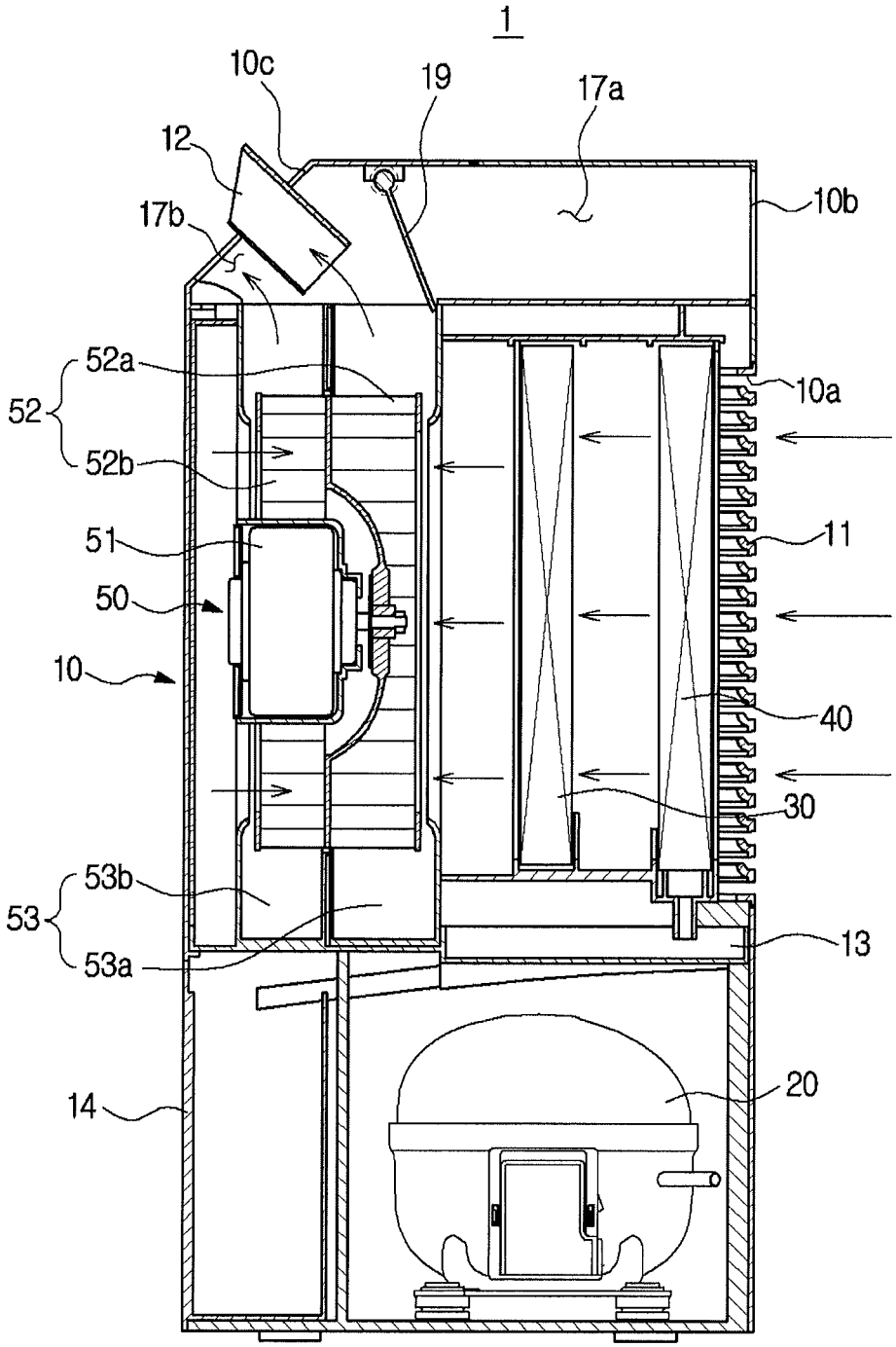
FIG. 5 is a side sectional view showing operation of the dehumidifier in a dehumidification mode according to the embodiment of the present invention.
Figure 6:
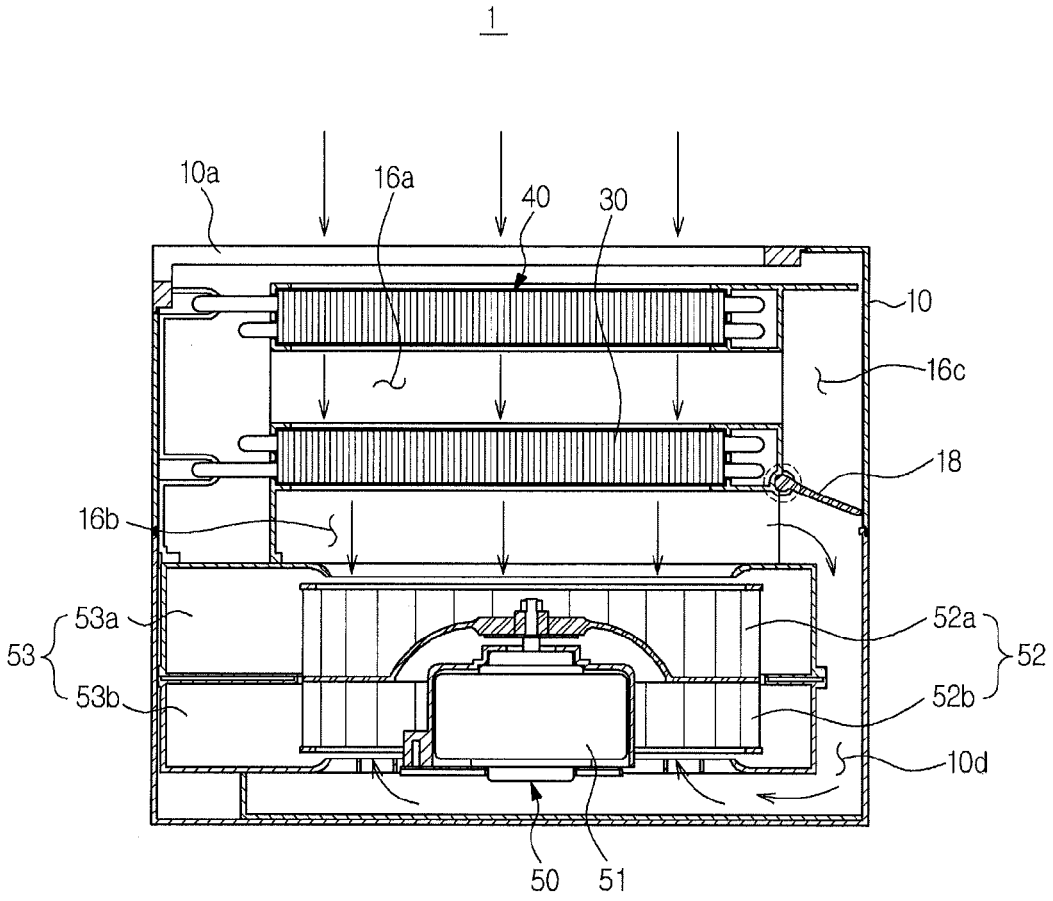
FIG. 6 is a plan sectional view showing operation of the dehumidifier in dehumidification mode according to the embodiment of the present invention.

First, when the dehumidifier 1 is operated in a dehumidification mode, as exemplarily shown in FIGS. 5 and 6, the first damper 18 closes the third suction path 16*c* and connects the second suction path 16*b* and the fourth suction path 10*d* to each other. In addition, the second damper 19 connects the second duct 53*b* and the second discharge path 17*b* to each other.

When the fan 52 is rotated in such a state, air is suctioned through the suction aperture 10*a*, passes through the evaporator 40, the first suction path 16*a*, and the condenser 30 in sequence, and is delivered to the second suction path 16*b*. Some of the air delivered to the second suction path 16*b* is delivered to the first blowing part 52*a* and the remaining air is delivered to the second blowing part 52*b* through the fourth suction path 10*d*.

In succession, the air discharged from the first blowing part 52*a* and the second blowing part 52*b* of the fan 52 passes through the guide duct 53 and the second discharge path 17*b* in sequence, and is discharged outward through the second discharge aperture 10*c*. In this case, since the air discharged through the second discharge aperture 10*c* had been cooled while passing through the evaporator 40 and then had absorbed heat while passing through the condenser 30, the resulting air discharged through the second discharge aperture 10*c* has lower humidity and slightly higher temperature than the air had prior to being suctioned into the main body 10.

Figure 7:
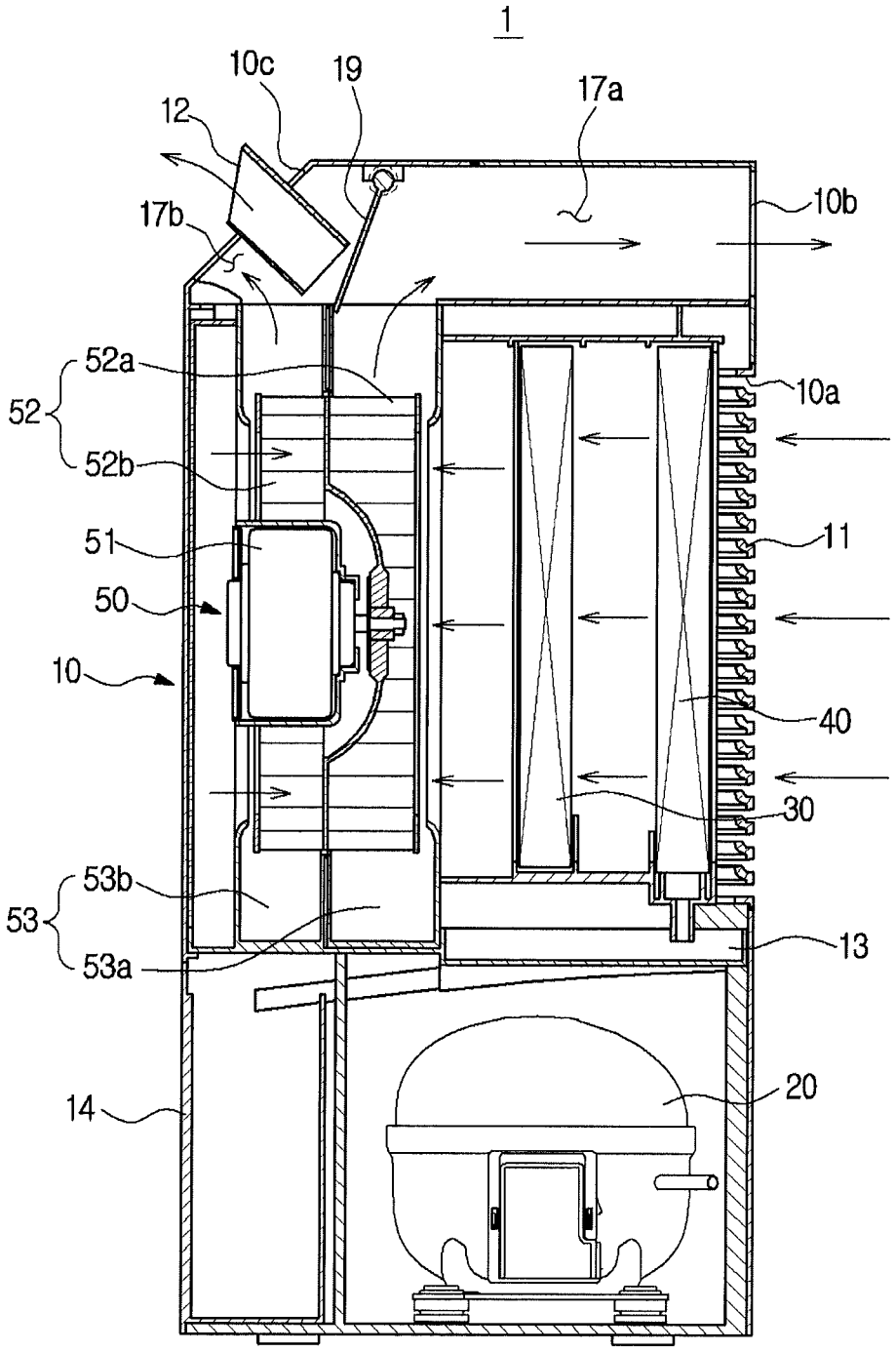
FIG. 7 is a side sectional view showing operation of the dehumidifier in a cold air supply mode according to the embodiment of the present invention.
Figure 8:
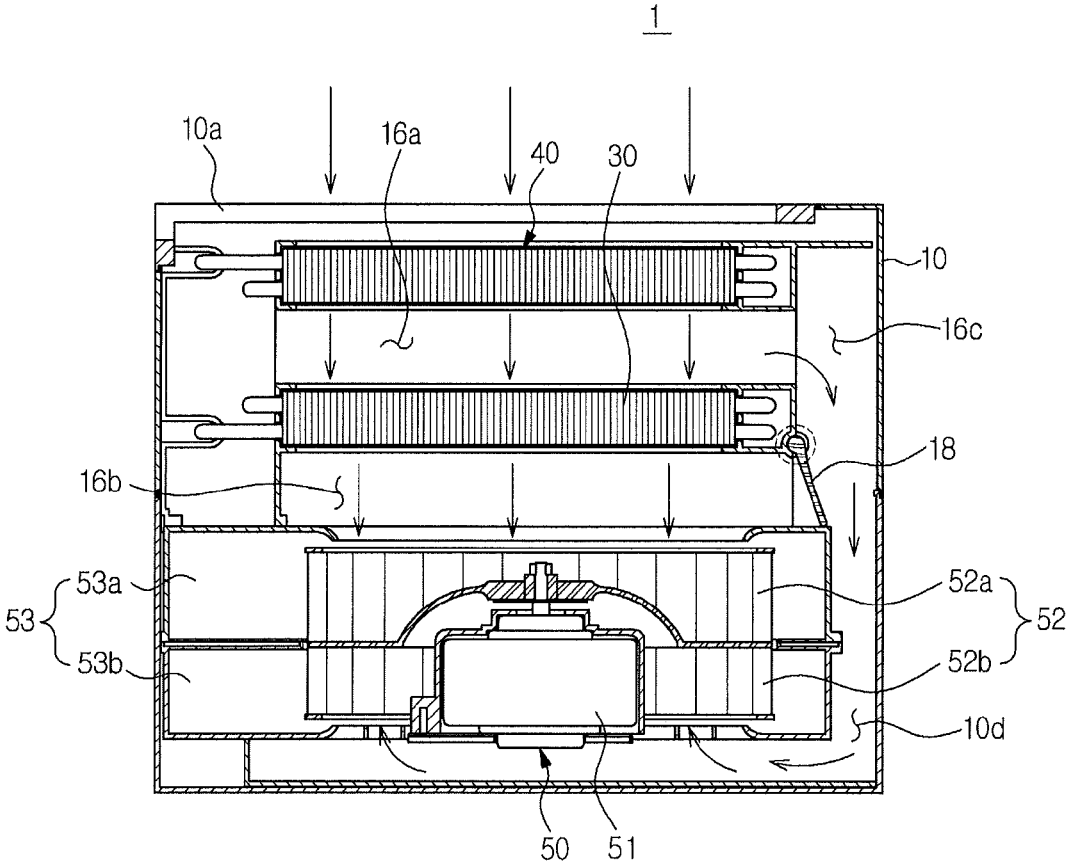
FIG. 8 is a plan sectional view showing operation of the dehumidifier in a cold air supply mode according to the embodiment of the present invention.

Next, when the dehumidifier 1 is operated in a cold air supply mode, as exemplarily shown in FIGS. 7 and 8, the first damper 18 closes the second suction path 16*b* and connects the third suction path 16*c* and the fourth section path 10*d* to each other. In addition, the second damper 19 connects the second duct 53*b* and the first discharge path 17*a* to each other.

When the fan 52 is rotated in such a state, air is suctioned through the suction aperture 10*a*. The air suctioned through the suction aperture 10*a* passes through the evaporator 40 and is delivered to the first suction path 16*a*.

Some of the air delivered to the first suction path 16*a* passes through the condenser 30 and the second suction path 16*b* in sequence and is delivered to the first blowing part 52*a*, and the remaining air bypasses the condenser 30 to pass through the third suction path 16*c* and the fourth suction path 10*d* in sequence and is delivered to the second blowing part 52*b*.

The air delivered to the first blowing part 52*a* passes through the first duct 53*a* and the first discharge path 17*a* in sequence and is discharged outward through the first discharge aperture 10*b*. The air delivered to the second blowing part 52*b* passes through the second duct 53*b* and the second discharge path 17*b* in sequence and is discharged outward through the second discharge aperture 10*c*.

In this case, since the air discharged through the first discharge aperture 10*b* had been cooled while passing through the evaporator 40 and had been heated while passing through the condenser 30, the resulting air discharged through the first discharge aperture 10*b* has lower humidity and slightly higher temperature than the air had prior to being suctioned into the main body 10.

In addition, since the air discharged through the second discharge aperture 10*c* had passed through only the evaporator 40 and bypassed the condenser 30, the air, cooled by the evaporator 40, is directly discharged through the second discharge aperture 10*c*. Thereby, the resulting air discharged through the second discharge aperture 10*c* has lower humidity and lower temperature than the air had prior to being suctioned into the main body 10. That is, cold air is supplied through the second discharge aperture 10*c*.

As is apparent from the above description, in one embodiment, a fan of a dehumidifier includes a first blowing part and a second blowing part, and the second blowing part is adapted to blow any one of high temperature air, having passed through both a condenser and an evaporator, and low temperature air having passed through only the evaporator. In this way, the dehumidifier may achieve an additional function to supply cold air.

Although the embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A dehumidifier comprising:

a main body;

an evaporator and a condenser arranged within the main body; and a fan to suction air into the main body and discharge the air from the main body, a first damper to selectively direct air that has moved through the evaporator and the condenser to the fan, or air that has moved through only the evaporator to the fan; and wherein the fan includes a first blowing part and a second blowing part, and wherein either the air having passed through both the evaporator and the condenser moves through the first and second blowing parts, or the air having passed through both the condenser and the evaporator moves through the first blowing part and the air having passed through only the evaporator moves through the second blowing part.

2. The dehumidifier according to claim 1, wherein the first blowing part suctions air in one axial direction and discharges the air in an outward radial direction, and wherein the second blowing part suctions air in an opposite axial direction and discharges the air in an outward radial direction.

3. The dehumidifier according to claim 1, wherein the main body includes a suction aperture through which air is suctioned into the main body, a first discharge aperture through which air discharged from the first blowing part is discharged out of the main body, and a second discharge aperture through which air discharged from at least the second blowing part, among the first blowing part and the second blowing part, is discharged out of the main body.

4. The dehumidifier according to claim 3, further comprising a second damper to guide air blown by the first blowing part so as to be selectively discharged through either the first discharge aperture or the second discharge aperture.

5. The dehumidifier according to claim 4, wherein the main body includes a first discharge path to guide air to the first discharge aperture and a second discharge path to guide air to the second discharge aperture, and wherein the first discharge path and the second discharge path meet.

6. The dehumidifier according to claim 5, wherein the second damper is rotatably installed where the first discharge path and the second discharge path meet.

7. The dehumidifier according to claim 1, wherein the main body includes a first suction path to guide air having passed through the evaporator to the condenser, a second suction path to guide air having passed through the condenser to the first blowing part, a third suction path branched from the first suction path to allow some of the air having passed through the evaporator to bypass the condenser, and a fourth suction path to guide air to be suctioned into the second blowing part, wherein the second, third and fourth suction paths meet, and wherein the first damper selectively connects either the second suction path or the third suction path to the fourth suction path.

8. The dehumidifier according to claim 7, wherein the first damper is rotatably installed where the second suction path, the third suction path and the fourth suction path meet, and closes either the second suction path or the third suction path via rotation thereof.

9. The dehumidifier according to claim 1, further comprising:

a motor to rotate the fan; and a guide duct to receive the fan, the guide duct guiding air discharged from the fan, wherein the guide duct includes a first duct in which the first blowing part is received, the first duct guiding air discharged from the first blowing part, and a second duct in which the second blowing part is received, the second duct guiding air discharged from the second blowing part.

10. The dehumidifier according to claim 1, wherein the main body accommodates a drain pan, and a container in which water from the drain pan is stored.

11. A dehumidifier comprising:

a main body;

an evaporator and a condenser arranged within the main body; and a fan to suction air into the main body and discharge the air from the main body, wherein the fan includes a first blowing part to suction air in one axial direction and discharge the air in an outward radial direction, and a second blowing part to suction air in an opposite axial direction and discharge the air in an outward radial direction, and wherein the main body includes a suction aperture through which air is suctioned into the main body, a first suction path to guide air, having been suctioned through the suction aperture and passed through the evaporator, to the condenser, a second suction path to guide air having passed through the condenser to the first blowing part, a third suction path branched from the first suction path to allow some of the air having passed through the evaporator to bypass the condenser, a fourth suction path selectively connected to any one of the second suction path and the third suction path to guide air such that any one of air having passed through both the evaporator and the condenser and air having passed through only the evaporator is selectively suctioned into the second blowing part, and a first damper to connect either the second suction path or the third suction path to the fourth suction path, wherein the first damper is rotatably installed where the second suction path, the third suction path and the fourth suction path meet.

12. The dehumidifier according to claim 11, wherein the main body includes a first discharge aperture through which air discharged from the first blowing part is discharged out of the main body, a second discharge aperture through which air discharged from at least the second blowing part among the first blowing part and the second blowing part is discharged out of the main body, a first discharge path to guide air to the first discharge aperture, a second discharge path to guide air to the second discharge aperture, and a second damper to allow air discharged from the first blowing part to be delivered to either the first discharge path or the second discharge path.

13. A dehumidifier comprising:

a main body;

an evaporator and a condenser arranged within the main body; and a fan to force air into the main body and discharge the air from the main body;

a first damper to selectively direct air that has moved through the evaporator and the condenser to the fan, or air that has moved through only the evaporator to the fan, wherein the fan includes a first blowing part and a second blowing part, and wherein either the air having passed through both the evaporator and the condenser moves through the first and second blowing parts, or the air having passed through both the condenser and the evaporator moves through the first blowing part and the air having passed through only the evaporator moves through the second blowing part;

a suction aperture through which air is suctioned into the main body;

a first discharge aperture through which air discharged from the first blowing part is discharged out of the main body;

a second discharge aperture through which air discharged from at least the second blowing part among the first blowing part and the second blowing part, is discharged out of the main body, wherein the second discharge aperture is installed at the main body to be oriented in a direction opposite to a direction in which the first discharge aperture is oriented; and a second damper to guide air from the first blowing part to either the first discharge aperture or the second discharge aperture.

14. The dehumidifier according to claim 13, wherein the first blowing part suctions air in one axial direction and discharges the air in an outward radial direction, and wherein the second blowing part suctions air in an opposite axial direction and discharges the air in an outward radial direction.

15. The dehumidifier according to claim 13, wherein the main body includes a first suction path to guide air having passed through the evaporator to the condenser, a second suction path to guide air having passed through the condenser to the first blowing part, a third suction path branched from the first suction path to allow some of the air having passed through the evaporator to bypass the condenser, and a fourth suction path to guide air to be suctioned into the second blowing part, wherein the second, third and fourth suction paths meet, and wherein the first damper selectively connects either the second suction path or the third suction path to the fourth suction path.

16. The dehumidifier according to claim 15, wherein the first damper is rotatably installed where the second suction path, the third suction path and the fourth suction path meet, and closes either the second suction path or the third suction path via rotation thereof.

17. The dehumidifier according to claim 13, wherein the main body includes a first discharge path to guide air to the first discharge aperture and a second discharge path to guide air to the second discharge aperture, and wherein the first discharge path and the second discharge path meet.

18. The dehumidifier according to claim 17, wherein the second damper is rotatably installed where the first discharge path and the second discharge path meet.

19. The dehumidifier according to claim 13, further comprising:

a motor to rotate the fan; and a guide duct to receive the fan, the guide duct guiding air discharged from the fan, wherein the guide duct includes a first duct in which the first blowing part is received, the first duct guiding air discharged from the first blowing part, and a second duct in which the second blowing part is received, the second duct guiding air discharged from the second blowing part.

20. The dehumidifier according to claim 13, wherein the main body accommodates a drain pan, and a container in which water from the drain pan is stored.

* * * * *